US009932926B2

(12) United States Patent
Kim et al.

(10) Patent No.: US 9,932,926 B2
(45) Date of Patent: Apr. 3, 2018

(54) INJECTOR CONTROLLING METHOD USING OPENING DURATION

(71) Applicant: HYUNDAI AUTRON CO., LTD., Seongnam-si (KR)

(72) Inventors: Yongha Kim, Seongnam-si (KR); Youngjae Kim, Gunpo-si (KR); Hyunjae Cho, Seongnam-si (KR)

(73) Assignee: Hyundai Autron Co., Ltd., Seongnam-si (KR)

( * ) Notice: Subject to any disclaimer, the term of this patent is extended or adjusted under 35 U.S.C. 154(b) by 0 days.

(21) Appl. No.: 15/368,301

(22) Filed: Dec. 2, 2016

(65) Prior Publication Data

US 2017/0175666 A1 Jun. 22, 2017

(30) Foreign Application Priority Data

Dec. 7, 2015 (KR) ..... 10-2015-0173470

(51) Int. Cl.
*F02M 65/00* (2006.01)
*F02D 41/40* (2006.01)
(Continued)

(52) U.S. Cl.
CPC ..... *F02D 41/40* (2013.01); *F02D 41/1402* (2013.01); *F02D 41/20* (2013.01); *F02D 41/2467* (2013.01); *F02M 51/005* (2013.01); *F02M 51/061* (2013.01); *F02M 65/001* (2013.01); *F02M 65/005* (2013.01); *F02D 41/0085* (2013.01); *F02D 2041/2024* (2013.01); *F02D 2041/2051* (2013.01);
(Continued)

(58) Field of Classification Search
CPC .... F02D 41/40; F02D 41/401; F02D 41/1402; F02D 41/34; F02D 41/3005; F02D 41/345; F02D 41/36; F02D 41/365; F02D 41/38; F02D 41/3818; F02D 2200/0614; F02D 2200/0618; F02M 51/061; F02M 51/045; F02M 51/0614; F02M 51/0621; F02M 51/0639; F02M 51/0664; F02M 51/0689; F02M 65/001; F02M 65/005; B66C 1/108; H01F 13/003; H01H 41/325
See application file for complete search history.

(56) References Cited

U.S. PATENT DOCUMENTS

2011/0251808 A1* 10/2011 Serra ..... F02D 41/20 702/64
2012/0116702 A1* 5/2012 Beer ..... F02D 41/20 702/65
(Continued)

FOREIGN PATENT DOCUMENTS

JP 2014-218981 A 10/2013
JP 2015-135102 A 7/2015
(Continued)

*Primary Examiner* — Lindsay Low
*Assistant Examiner* — George Jin
(74) *Attorney, Agent, or Firm* — Baker & McKenzie LLP; Hyunho Park

(57) ABSTRACT

Disclosed is an injector controlling method using an opening duration. The injector controlling method using an opening duration converts a target fuel quantity into an opening duration and sets relationship between the opening duration and an injector actuation signal in order to control the fuel quantity of injectors more accurately.

16 Claims, 7 Drawing Sheets

(51) Int. Cl.

| | |
|---|---|
| ***F02D 41/14*** | (2006.01) |
| ***F02M 51/00*** | (2006.01) |
| ***F02M 51/06*** | (2006.01) |
| ***F02D 41/24*** | (2006.01) |
| ***F02D 41/20*** | (2006.01) |
| *F02D 41/00* | (2006.01) |

(52) U.S. Cl.
CPC ..... *F02D 2041/2055* (2013.01); *F02D 2041/2058* (2013.01); *F02D 2200/0614* (2013.01); *F02D 2200/0618* (2013.01); *F02M 51/0664* (2013.01)

(56) References Cited

U.S. PATENT DOCUMENTS

| | | | | |
|---|---|---|---|---|
| 2013/0104636 | A1* | 5/2013 | Beer | F02D 41/20 73/114.49 |
| 2015/0226148 | A1* | 8/2015 | Beer | F02D 41/247 123/480 |
| 2016/0138511 | A1* | 5/2016 | Toyohara | F02D 41/20 123/478 |
| 2016/0237937 | A1* | 8/2016 | Kusakabe | F02D 41/20 |
| 2016/0281629 | A1* | 9/2016 | Moriya | F02D 41/2467 |
| 2017/0022928 | A1* | 1/2017 | Jin | F02D 41/401 |

FOREIGN PATENT DOCUMENTS

| | | | |
|---|---|---|---|
| JP | 2015-172346 | A | 10/2015 |
| KR | 10-2012-0052978 | A | 5/2012 |
| KR | 10-2013-0119934 | A | 11/2013 |

* cited by examiner

INJECTOR CONTROLLING METHOD USING OPENING DURATION

CROSS-REFERENCE TO RELATED APPLICATION

The present application claims the benefit of priority from Korean Patent Application No. 10-2015-0173470 filed in the Korean Intellectual Property Office on Dec. 7, 2015, the entire contents of which are incorporated herein by reference.

BACKGROUND OF THE INVENTION

Field of the Invention

The present invention relates to an injector controlling method using an opening duration, and more particularly, to a method for controlling an actuation signal of an injector using an opening duration by converting a target fuel quantity of the injector into the opening duration.

Background Art

The statements in this section merely provide background information related to the present disclosure and may not constitute prior art.

A fuel injection type of a vehicle engine is generally divided into a port injection type and a direct injection type. Here, the port injection type is mainly used in a gasoline engine and adopts the way to supply fuel-air mixture to the inside of a cylinder by injecting fuel to an intake port.

The direction injection type is mainly used in a diesel engine and adopts the way to directly inject fuel to the inside of the cylinder.

However, recently, technology to adopt the direct injection type to the gasoline engine with the purposes of improvement of fuel efficiency and output and prevention of environmental pollution is in the spotlight. Such an engine is called a GDI (Gasoline Direct Injection) engine, and is the way that air is inhaled to a combustion chamber from an intake port and is compressed by a piston and fuel is directly injected relative to air of high pressure introduced into the combustion chamber when an intake valve is opened.

The GDI engine has injectors respectively mounted on cylinders to inject fuel at high pressure. A solenoid of each injector injects fuel into the combustion chamber by opening an injection outlet when receiving an actuation signal from a controller, and then, closes the injection outlet when injection is finished.

However, even though the injection outlets of the injectors are opened at the same time, the injectors are different from one another in the time that the injection outlets are closed due to differences in abrasion and deterioration of the injectors, internal friction of needles or internal friction of an amateur and a difference in elastic modulus of a return spring, and hence, the fuel quantity injected by the injector is varied.

The conventional technologies have adopt the method of controlling the injector by converting the target fuel quantity into an actuation signal through a map in which relationship between the target fuel quantity and the actuation signal for actuating the injector is set.

However, as described above, the conventional method has several disadvantages in that the injectors are different in the degree of opening from one another even though the same actuation signal is applied to the injectors, in that it is difficult to accurately control the fuel quantity even though various calibrated maps because the injector actuation time and the degree of opening of the injectors are not simply proportional to each other, and in that problems, such as combustion instability and excessive discharge of particulate matters if the quantity of fuel injected is small.

SUMMARY OF THE INVENTION

Accordingly, the present invention has been made in view of the above-mentioned problems occurring in the prior art, and it is an object of the present invention to provide an injector controlling method using an opening duration, which converts a target fuel quantity into an opening duration and sets relationship between the opening duration and an injector actuation signal in order to control the fuel quantity of injectors more accurately.

Technical objects to be achieved by the present invention are not limited to the above-described objects and other technical objects that have not been described will be evidently understood by those skilled in the art from the following description.

To accomplish the above object, according to the present invention, there is provided an injector controlling method using an opening duration including: a first step of applying actuation signals to a plurality of injectors and securing a time profile of the output voltage; a second step of evaluating the time profile to determine the closing time of the injectors; a third step of learning the opening durations of the injectors based on the closing time; a fourth step of selecting a standard injector out of the injectors; and a fifth step of determining an actuation signal to be inputted into the remaining injectors except the standard injector based on the learned opening duration of the standard injector.

In the first step, the output voltage is a self-induced voltage which is created when a current flow is interrupted after the current flow is formed on the injector by the actuation signal.

The second step includes the steps of finding an inflection point from the time profile of the self-induced voltage and determining the closing time based on the inflection point.

The inflection point is formed while the self-induced voltage is decayed.

The third step includes the steps of: determining the opening time based on a current peak value of the actuation signal; determining a time interval between the opening time and the closing time as an opening duration; and storing the determined opening duration.

In the fourth step, the standard injector is selected by comparing the learned opening durations of the plural injectors.

When the fuel quantity corresponding to the learned opening durations of the injectors is divided into a maximum value, an intermediate value and a minimum value, the standard injector is selected among the injectors having the intermediate value.

The fifth step includes the steps of: matching the learned opening durations of the injector except the standard injector with the learned opening duration of the standard injector, comparing the actuation signal of the standard injector with the actuation signal of the remaining injectors, and determining the actuation signals of the remaining injectors corresponding with the actuation signal of the standard injector relative to the matched opening duration.

The injector controlling method according to an embodiment of the present invention further includes a sixth step of applying the actuation signal determined in the fifth step to the remaining injectors in order to control fuel quantities of the injectors.

In the sixth step, the fuel quantity is determined applying the relationship between the learned opening duration of the standard injector and the fuel quantity.

In the sixth step, the fuel quantity is determined applying the relationship between the previously mapped opening duration and the fuel quantity.

Moreover, in another aspect of the present invention, the present invention provides a fuel quantity controlling method of an engine in which a plurality of injectors having solenoid coils are mounted, including the steps of: applying an actuation signal to the solenoid coil of each injector; cutting a flow of current flowing through the solenoid coil when the actuation signal is applied, such that the coil is in a currentless state; detecting a time profile of voltage induced from the coil of the currentless state; determining a closing time of the injector based on the detected time profile; determining an opening time of the injector based on the actuation signal, and learning relationship between an opening duration defined by the opening time and the closing time and the actuation signal; and selecting a standard injector out of the plural injectors, and deciding actuation signals for the remaining injectors except the standard injector based on relationship between the actuation signal of the standard injector and the opening duration.

The closing time in the closing time determining step is determined based on an inflection point of the time profile. The opening duration in the opening duration learning step is defined as a time zone between the opening time and the closing time.

Furthermore, in a further aspect of the present invention, the present invention provides a control device of an engine which has a plurality of injectors, including: an actuation signal transmitting unit for transmitting actuation signals to the injectors; an output signal receiving unit for receiving output voltage corresponding to the actuation signals from the injectors; and a control unit which secures a time profile of the output voltage and evaluates the time profile to determine a closing time of the injectors, learns relationship between an opening duration defined by the opening time and the closing time and the actuation signal, selecting a standard injector out of the plural injectors, and decides actuation signals for the remaining injectors except the standard injector based on the opening duration of the standard injector.

As described above, according to a preferred embodiment of the present invention, the injector controlling method using the opening duration can control the fuel quantity of injectors more accurately by converting the target fuel quantity into the opening duration and setting relationship between the opening duration and an injector actuation signal.

Besides the above, the present invention has various effects, such as excellent durability, and such effects will be clarified in the following detailed description of the preferred embodiment of the present invention.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
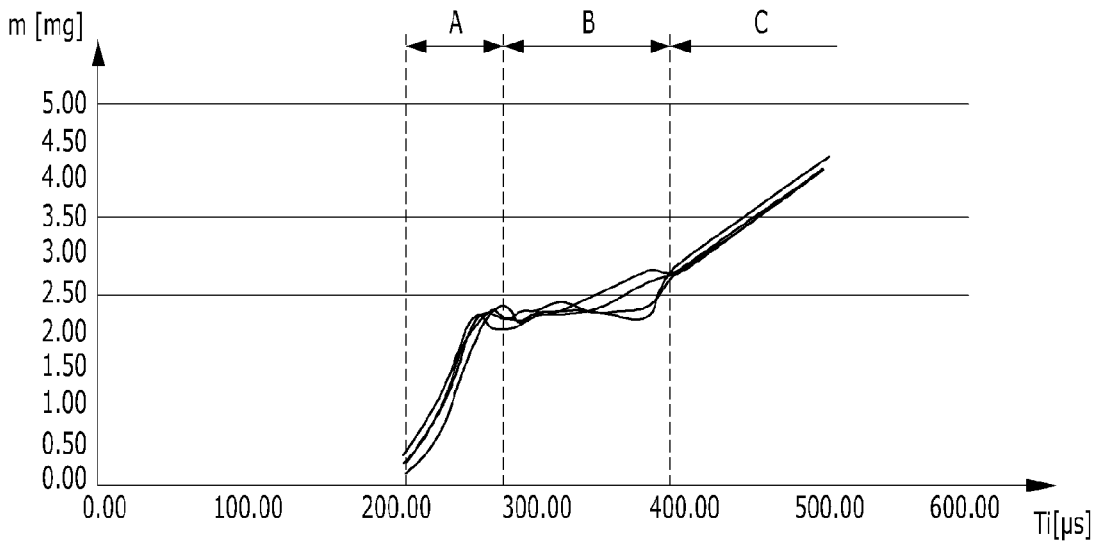
FIG. 1 illustrates relationship between a fuel quantity injected by an injector and actuation time that the injector electrically actuates.

Hereinafter, the present disclosure will be described in more detail with reference to the exemplary embodiments.

In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

Moreover, it should be understood that a size or shape of the elements illustrated in the drawings may be exaggeratedly drawn to more clearly and conveniently explain the present invention. Furthermore, the terms specifically defined in consideration of the configuration and operation of the present invention are just to describe the embodiments of the present invention but do not limit the scope of the present invention.

FIG. 1 shows relationship between fuel quantity (m) injected by injectors and actuation time (Ti) for electrically actuating the injectors. In FIG. 1, the X axis is indicated in microseconds (μs) and Y axis is indicated in milligrams (mg). Moreover, FIG. 1 illustrates a plurality of profiles showing relationship between the fuel quantity (m) of a plurality of the injectors and actuation time (Ti).

Here, the fuel quantity (m) injected into a combustion chamber by the injectors may be illustrated into function of the actuation time (Ti) that the injectors are actuated electrically.

Referring to FIG. 1, in a control system adopting the direct injection type, the fuel quantity (m) injected by the injectors may be divided into sections with different complexions according to actuation time (Ti) that the injectors are actuated electrically, and the sections may be generally called a ballistic section (A), a transient section (B) and a non-ballistic section (C).

The ballistic section (A) means the section where the fuel quantity (m) increases dramatically if there is any change in actuation time (Ti). The transient section (B) means the section where the fuel quantity (m) does not change significantly even though the actuation time (Ti) is changed greatly. The ballistic section (A) and the transient section (B) are all nonlinear sections. In the meantime, the non-ballistic section (C) is a linear section where the actuation time (Ti) and the fuel quantity (m) are in linear relationship. Referring to FIG. 1, the relation profiles of the injectors do not match with each other in the nonlinear sections but match with each other in the linear section.

In the meantime, the actuation time (Ti) that the injectors are actuated electrically may correspond with an actuation signal (Ti) applied to the injectors by a controller or actuation time (Ti) that an electric signal is applied to the injectors in order to actuate the injectors. Here, the actuation signal (Ti), for instance, is inputted into the injectors in the form of a PWM control signal. Hereinafter, in this embodiment of the present invention, the actuation time (Ti) that the injectors are actuated electrically will be described as the actuation signal (Ti) applied to the injectors.

Figure 2A:
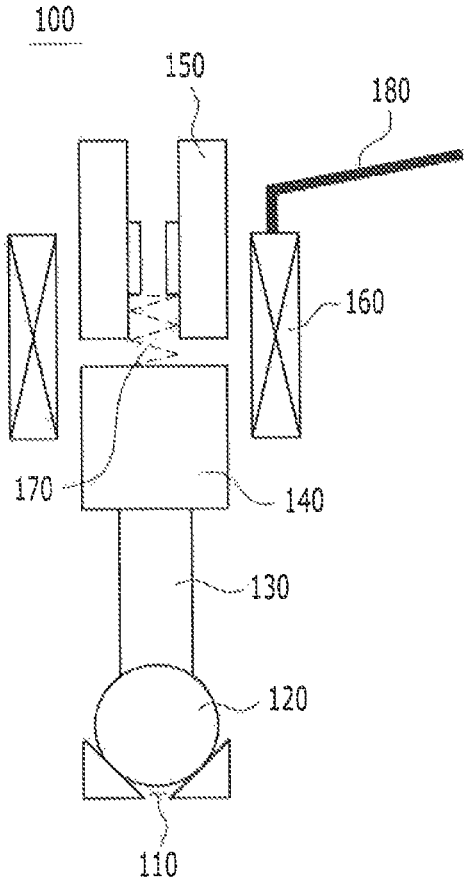
FIG. 2A shows a closed state of the injector.
Figure 2B:
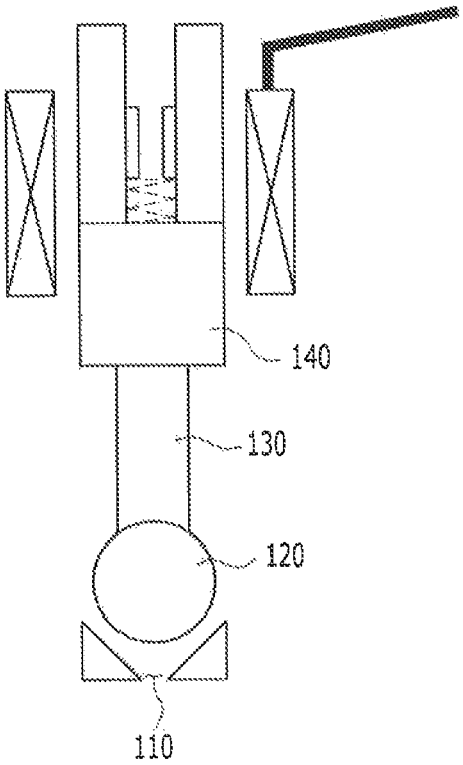
FIG. 2B shows an opened state of the injector.

FIGS. 2A and 2B are a schematic diagram showing the basic structure of the injector.

FIG. 2A shows a closed state of the injector, and FIG. 2B shows an opened state of the injector.

According to embodiments, the injector 100 includes: a valve 120 for opening and closing an injection outlet 110; a needle 130 of which the end is connected with the valve 120; an amateur 140 which is combined with the needle 130 so that the needle 130 makes a rectilinear motion; a magnetic member 150 which is arranged to surround the amateur 140 and forms a route of an electromagnetic field; a solenoid coil 160 which forms a solenoid magnetic field; and a return spring 170 for returning the needle 130 and the amateur 140 moved. The solenoid coil 160 is electrically connected with a control unit (not shown) by a wire harness 180 to receive a control signal.

In an embodiment of actuation of the injector 100, when the control signal is applied to the solenoid coil 160, an electromagnetic field is formed on the magnetic member 150, and the amateur 140 is moved by an absorption force created by the magnetic member 150 and concentration of the magnetic force. When the amateur 140 moves the needle 130, the injection outlet 110 is opened or closed.

FIG. 2B shows a state where the injection outlet 110 is opened when the amateur, the needle and the valve are moved upwardly.

Figures 3A, 3B:
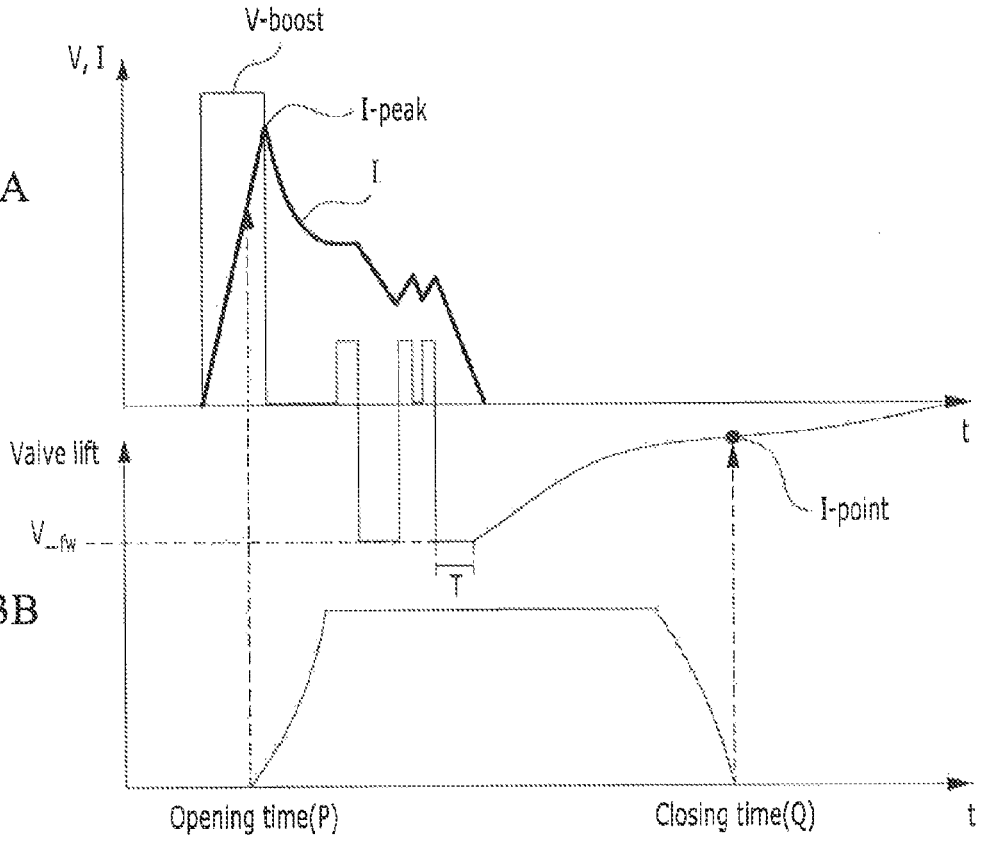
FIG. 3A is a schematic diagram of a general current operation profile relative to the injector.
FIG. 3B is a view showing the time that an injection outlet of the injector is opened and the time that the injection outlet is closed.

FIG. 3A is a schematic diagram of a general current operation profile relative to the injector, and FIG. 3B shows the time that the injection outlet of the injector is opened and the time that the injection outlet is closed. In FIG. 3A, the X axis indicates time (t) and the Y axis indicates intensity of current (I) or voltage (V). Here, the thick line indicates a time profile relative to the current (I) and the thin line indicates a time profile relative to voltage (V).

FIG. 3B shows the time (P) that the injection outlet 110 is opened while the valve of the injector is lifted and delayed mechanically and the time (Q) that the valve 120 is seated and the injection outlet 110 is closed. FIG. 3B shows that the valve 120 is rapidly accelerated and opened at the opening time (P), maintains the opened state, and then, is closed at the closing time.

The opening time (P) corresponds to just short of the maximum current value (I_peak) of the time profile relative to the current (I), and the closing time (Q) correspond to the position of an inflection point (I_point) of the time profile relative to voltage (V).

The control unit for controlling the opening time (P) and the closing time (Q) of the injector 100 transfers a control signal to the injector 100 to open or close the injection outlet 110 of the injector 100.

When boost voltage (V_boost) is applied till the current (I) flowing to the solenoid coil 160 of the injector 100 by the control signal reaches the maximum current value (I_peak), the injection outlet 110 of the injector 100 is opened in an accelerated manner due to a sudden rise of the current (I).

A start point of the electrical actuation of the injector 100 is determined while the applied boost voltage (V_boost) reaches the maximum current value (I_peak), and the start point of the electrical actuation may be the opening time (P) of the injection outlet 110 of the injector 100.

Because the opening time (P) of the injection outlet 110 is the time that the electric signal is inputted to the injector 100 and the needle 130 is lifted due to the sudden acceleration, the injectors 100 respectively mounted on the cylinders are all the same or similar. Therefore, in the present invention, the opening time (P) of the injection outlet 110 of the injector 100 will not be mentioned. However, even though the opening time (P) is not mentioned, the scope of the patent right in a case that the opening time (P) of the injection outlet 110 is varied is not excluded.

Meanwhile, when the current flowing in the solenoid coil 160 of the injector 100 is cut off by switching-off, self-induced voltage (V) is formed in the solenoid coil 160 of a currentless state, and the self-induced voltage (V) causes a flow of current passing through the solenoid coil 160 and the flow of current creates self-induced voltage (V) while reducing the magnetic field. The self-induced voltage (V) is indicated as negative voltage (V) in FIG. 3A, and is converged to 0 bolt (V) as time goes by. After decrease of magnetic force, the injection outlet 110 of the injector 100 is closed by restoring force caused by elastic force of the return spring 170 and fuel pressure.

While the self-induced voltage (V) is converged to 0 bolt (V) by switching-off, the inflection point (I_point) may be formed at the time profile relative to voltage (V), and the time that the inflection point (I_point) is formed may be the closing time (Q) of the injection outlet 110 of the injector 100.

The opening duration corresponds to a period of time that the injector 100 is opened, means a time interval during injection of fuel, and may be defined as a time interval between the opening time (P) and the closing time (Q) of the injector 100.

Because the opening time points (P) of all of the injectors 100 respectively mounted on the cylinders are the same or similar but the closing time points (Q) are varied, learning of the closing time (Q) corresponding to the actuation signal (Ti) may be learning of the opening duration.

Figure 4:
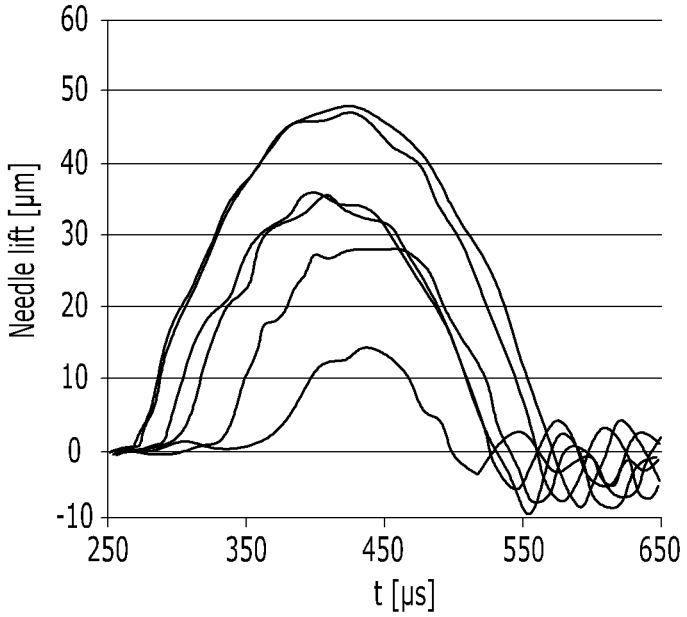
FIG. 4 is a graph showing a deviation in the degree of opening of injection outlets of injectors respectively mounted on cylinders in a ballistic section.

FIG. 4 is a graph showing a deviation in the degree of opening of the injection outlets of the injectors respectively mounted on the cylinders in a ballistic section. In FIG. 4, the X axis indicates an axis of time (t) indicated in microseconds (μs), and the Y axis indicates a lifted level of the needles 130 of the injectors indicated in micrometers (μm).

Figure 5:
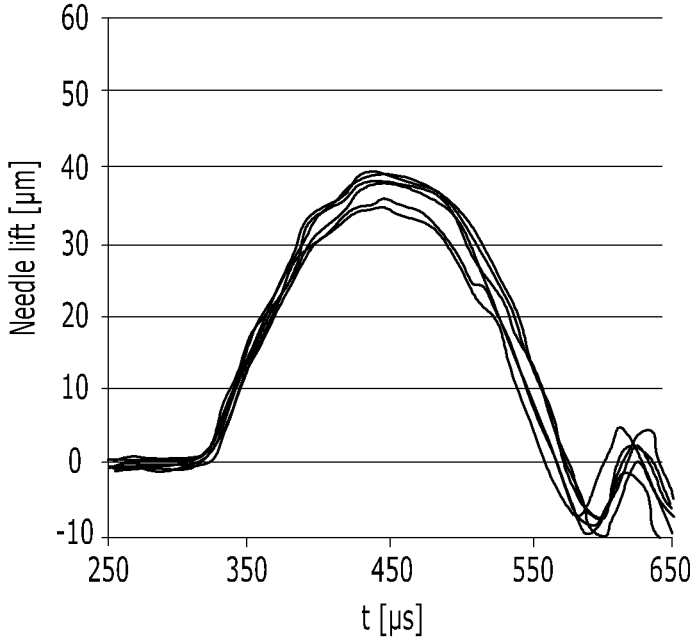
FIG. 5 is a graph showing that learning of an opening duration relative to the injectors respectively mounted on the cylinders is carried out and the deviation shown in FIG. 4 is compensated through an accurate and precise control using the result of learning.

FIG. 5 is a graph showing that learning of an opening duration relative to the injectors respectively mounted on the cylinders is carried out and the deviation shown in FIG. 4 is compensated through an accurate and precise control using the result of learning.

Even though the same actuation signals are applied to the injectors 100 because the opening time points (P) of the injection outlets 110 are the same in the ballistic section but the closing time points (Q) are varied, some of the injectors 100 reach a full-lifted state but some of the injectors 100 do not reach the full-lifted state. That is, even though the same actuation signals (Ti) are applied to the injectors 100, the opening durations of the injectors 100 respectively mounted on the cylinders are all different from one another. Because such a difference in opening duration causes a difference in fuel quantity injected into the combustion chamber, it is difficult to accurately control the injectors.

The injectors 100 respectively mounted on the cylinder are divided into a minimum injector 100, a norminal injector 100 and a maximum injector according to the fuel quantity injected by the injectors 100 when the same actuation signals (Ti) are applied to the injectors 100. Here, as a standard injector 100, the norminal injector 100 is selected in the present invention. Relationship between the actuation signal (Ti) to the standard injector 100 is determined and mapped. After that, in order to output the opening duration identical with the opening duration of the standard injector 100, the actuation signals (Ti) of other injectors 100 are respectively determined such that the opening durations of all injectors 100 can be outputted equally.

Referring to FIGS. 1 and 3, in order to output the opening durations of all injectors 100 equally, it is necessary to learn opening durations of all injectors 100. Learning of the opening duration can be achieved through the steps of: applying various previously set actuation signals (Ti) to all injectors 100 and receiving output voltage (V) created by self-induction at the time of switching-off; analyzing the time profile of the output voltage (V) to grasp the inflection point (I_point); and determining the closing time (Q) of the injection outlet 110 or the opening duration based on the inflection point (I_point).

As described above, after learning the opening durations relative to the injectors 100, relationship between the actuation signals (Ti) of all injectors 100 and the opening durations is determined and mapped (See FIG. 6A), and then the actuation signals (Ti) of the injectors 100 except the standard injector 100 to output opening durations which are the same or similar with the opening duration of the standard injector 100, so that the opening durations of all injectors 100 can coincide with one another.

Figure 6A:
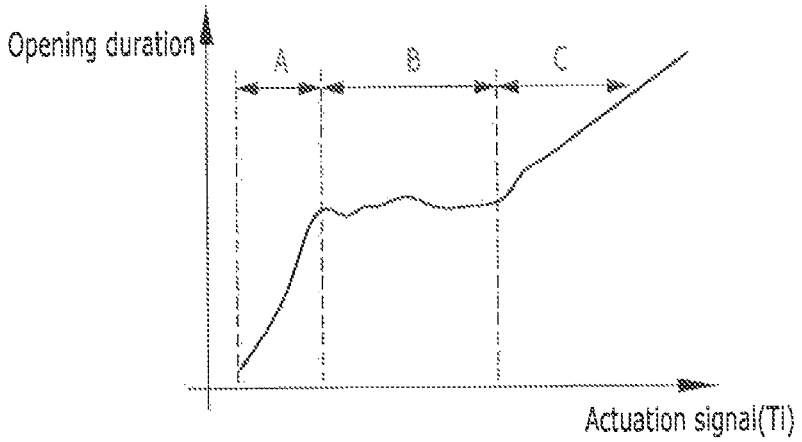
FIG. 6A shows relationship between the opening duration obtained through learning of the opening duration and an actuation signal.

FIG. 6A shows relationship between the opening duration obtained through learning of the opening duration and an actuation signal. In FIG. 6A, the profile shows that the actuation signals (Ti) corresponding to a plurality of previously set learning points are applied to the injector 100, the inflection point (I_point) is searched on the time profile of the output voltage (V) and the closing time (Q) of the injector 100, namely, the opening duration is determined and mapped.

FIG. 6A shows that the relationship between the opening duration and the actuation signal (Ti) is differentiated into a ballistic section (A), a transient section (B) and a non-ballistic section (C), and that the relationship between the opening duration and the actuation signal (Ti) is very similar with the relationship between the fuel quantity (m) and the actuation signal (Ti). Such similarity will be described later referring to FIG. 6B.

Figure 6B:
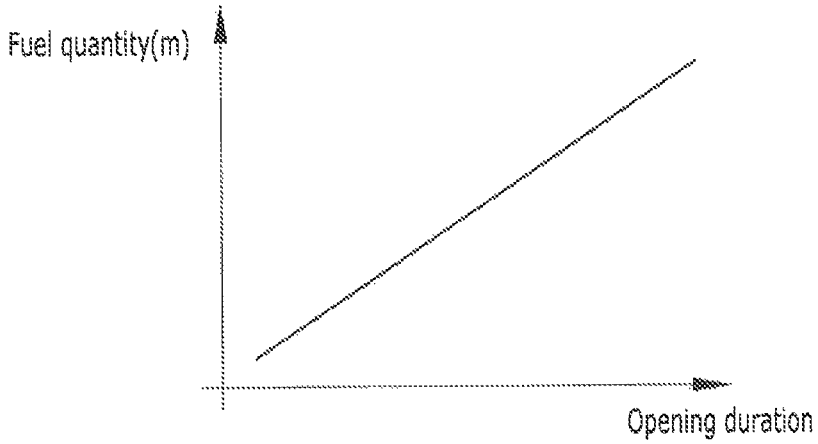
FIG. 6B shows relationship between the fuel quantity and the opening duration.

FIG. 6B shows relationship between the fuel quantity and the opening duration.

In the meantime, as described above, because the opening duration is the fuel injection period of time, it directly has an influence on the fuel quantity (m) injected into the combustion chamber. Therefore, the fuel quantity (m) injected by the injector 100 may show a little off-set in the relationship with the opening duration, but is in a linear relation. Therefore, when the relationship between the fuel quantity (m) and the opening duration is mapped (See FIG. 6B) and the relationship between the opening duration and the actuation signal (Ti) is mapped (See FIG. 6A), the controller can select and output the actuation signal (Ti) corresponding to an operator's desired fuel quantity.

Figure 7:
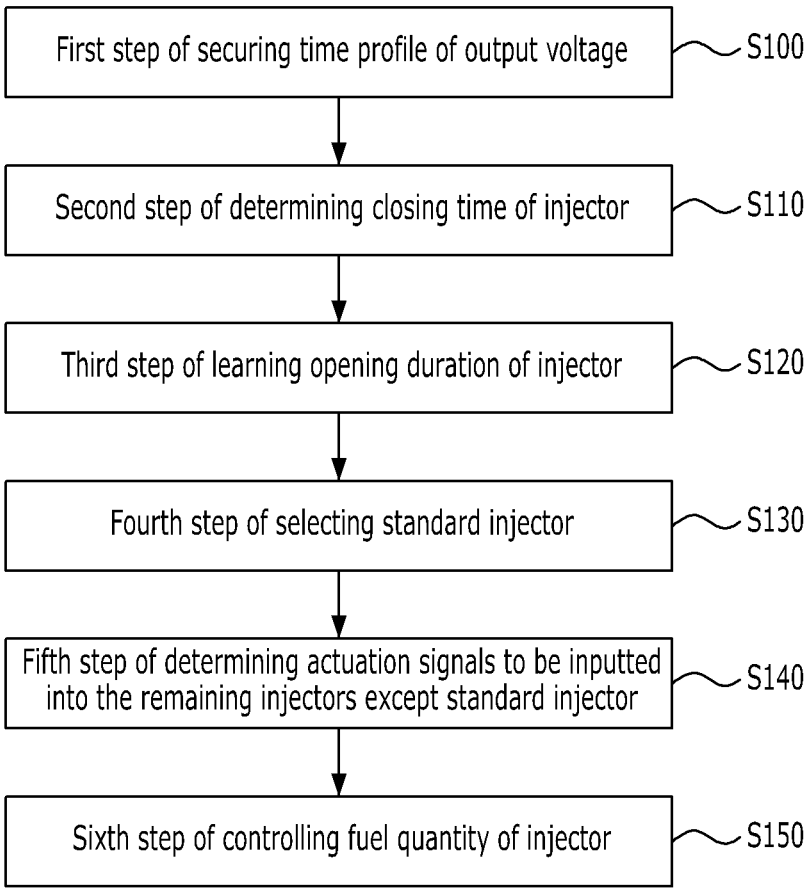
FIG. 7 is a view showing an injector controlling method according to a preferred embodiment of the present invention.

FIG. 7 is a view showing an injector controlling method according to a preferred embodiment of the present invention.

The injector controlling method according to the preferred embodiment of the present invention is based on the opening duration, and includes: a first step (S100) of applying actuation signals (Ti) to a plurality of injectors 100 and securing a time profile of the output voltage (V); a second step (S110) of evaluating the time profile to determine the closing time (Q) of the injectors 100; a third step (S120) of learning the opening durations of the injectors 100 based on the closing time (Q); a fourth step (S130) of selecting a standard injector 100 out of the injectors 100; and a fifth step (S140) of determining an actuation signal (Ti) to be inputted into the remaining injectors 100 except the standard injector 100 based on the learned opening duration of the standard injector 100.

Here, the time profile of the output voltage (V) may show an aspect that intensity of the output voltage (V) is varied as time goes by.

Furthermore, the output voltage (V) in the first step (S100) may be a self-induced voltage (V) which is created when a current flow is interrupted after the current flow is formed on the injector 100 by the actuation signal (Ti). In detail, the output voltage (V) may be the self-induced voltage (V) formed by interruption of external power source after the current flow is formed when the external power source is supplied to the solenoid coil 160 of the injector 100.

In the second step (S110), to determine the closing time (Q) of the injector 100 by evaluating the time profile may mean to find an inflection point (I_point) from the time profile of the self-induced voltage (V) and determine the closing time (Q) based on the inflection point (I_point) according to embodiments. For instance, the inflection point (I_point) may be formed while the self-induced voltage (V) is decayed in the time profile of the self-induced voltage (V), and the point where the corresponding inflection point (I_point) is formed may be determined as the closing time (Q).

In other words, the second step (S110) may include a process of finding the inflection point (I_point) from the time profile by evaluating the time profile of the output voltage (V) and determining the closing time (Q) based on the inflection point (I_point).

In the fourth step (S130), the standard injector 100 may be selected among the injectors 100, but according to embodiments, may be selected by comparing the learned opening durations of the injectors 100. In detail, when the degree of opening corresponding to the learned opening durations of the injectors 100 is divided into a maximum value, an intermediate value and a minimum value, the standard injector 100 may be selected among the injectors 100 having the intermediate value.

Meanwhile, the fuel quantity (m) corresponding to the opening duration may be selected through the relationship between the fuel quantity (m) and the opening duration, the injectors having the maximum value, the intermediate value and the minimum value may correspond with the maximum injector 100, the norminal injector 100 and the minimum injector 100.

In the fifth step (S140), the actuation signals (Ti) to be inputted when the remaining injectors 100 are controlled may be determined through the steps of matching the learned opening durations of the injector 100 except the standard injector 100 with the learned opening duration of the standard injector 100, comparing the actuation signal (Ti) of the standard injector 100 with the actuation signal (Ti) of the remaining injectors 100, and determining the actuation signals (Ti) of the remaining injectors 100 corresponding with the actuation signal (Ti) of the standard injector 100.

In the meantime, the injector controlling method according to a preferred embodiment of the present invention may further include a sixth step (S150) of applying the actuation signal (Ti) determined in the fifth step (S140) to the remaining injectors 100 in order to control fuel quantities (m) of the injectors 100. In the sixth step (S150), according to embodiments, the fuel quantity (m) may be determined applying the relationship between the previously mapped opening duration and the fuel quantity (m). Additionally, in the sixth step (S150), according to embodiments, the fuel quantity (m) may be determined applying the relationship between the learned opening duration of the standard injector 100 and the fuel quantity (m). Here, the relationship between the learned opening duration of the standard injector 100 and the fuel quantity (m) may be previously mapped.

Figure 8:
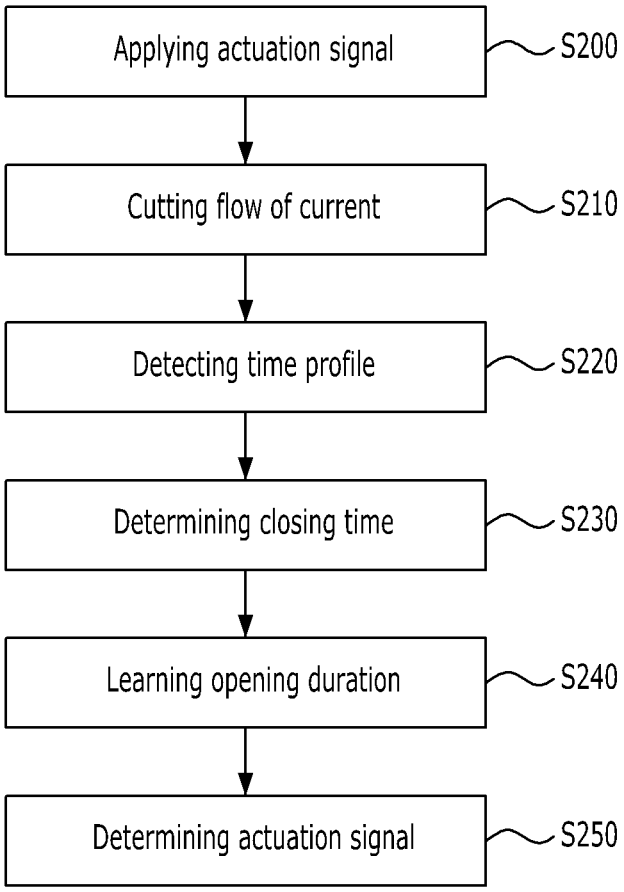
FIG. 8 is a view showing a fuel quantity controlling method of an injector according to another preferred embodiment of the present invention.

FIG. 8 is a view showing a fuel quantity controlling method of an injector according to another preferred embodiment of the present invention.

The fuel quantity controlling method of the injector 100 according to the preferred embodiment of the present invention for controlling fuel quantity of an engine in which a plurality of injectors 100 respectively having solenoid coils 160 are mounted includes the steps of: (S200) applying an actuation signal (Ti) to the solenoid coil 160 of each injector 100; (S210) cutting a flow of current flowing through the solenoid coil 160 when the actuation signal (Ti) is applied, such that the coil is in a currentless state; (S220) detecting a time profile of voltage (V) induced from the coil of the currentless state; (S230) determining a closing time (Q) of the injector 100 based on the detected time profile; (S240) determining an opening time (P) of the injector 100 based on the actuation signal (Ti), and learning relationship between an opening duration defined by the opening time (P) and the closing time (Q) and the actuation signal (Ti); and (S250) selecting a standard injector 100 out of the plural injectors 100, and deciding actuation signals (Ti) for the remaining injectors 100 except the standard injector 100 based on relationship between the actuation signal (Ti) of the standard injector 100 and the opening duration.

According to embodiments, the closing time (Q) in the closing time determining step (S230) may be determined based on an inflection point (I_point) of the time profile. Moreover, according to embodiments, the opening duration in the opening duration learning step (S240) may be defined as a time zone between the opening time (P) and the closing time (Q).

Figure 9:
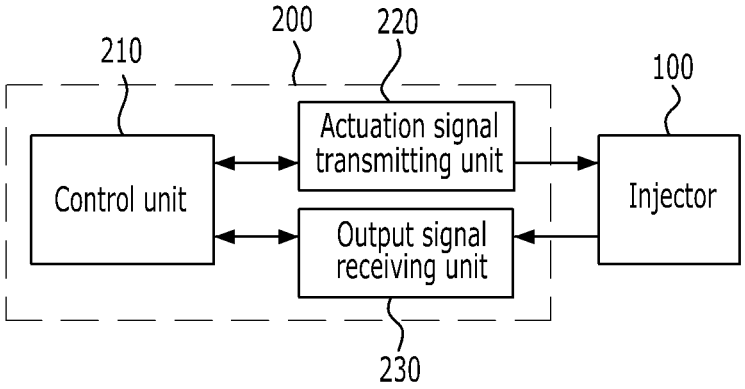
FIG. 9 is a control device of an engine according to a further preferred embodiment of the present invention.

FIG. 9 is a control device of an engine according to a further preferred embodiment of the present invention.

The control device 200 of the engine according to the preferred embodiment of the present invention, which has a plurality of injectors 100, includes: an actuation signal transmitting unit 220 for transmitting actuation signals (Ti) to the injectors 100; an output signal receiving unit 230 for receiving output voltage (V) corresponding to the actuation signals (Ti) from the injectors 100; and a control unit 210, which secures a time profile of the output voltage (V) and evaluates the time profile to determine a closing time (Q) of the injectors 100, learns relationship between an opening duration defined by the opening time (P) and the closing time (Q) and the actuation signal (Ti), selecting a standard injector 100 out of the plural injectors 100, and decides actuation signals (Ti) for the remaining injectors 100 except the standard injector 100 based on the opening duration of the standard injector 100.

As described above, while the present invention has been particularly shown and described with reference to the example embodiments thereof, it will be understood by those of ordinary skill in the art that the above embodiments of the present invention are all exemplified and various changes, modifications and equivalents may be made therein without changing the essential characteristics and scope of the present invention.

Therefore, it would be understood that the embodiments disclosed in the present invention are not to limit the technical idea of the present invention but to describe the present invention, and the technical and protective scope of the present invention shall be defined by the illustrated embodiments.

It should be also understood that the protective scope of the present invention is interpreted by the following claims and all technical ideas within the equivalent scope belong to the technical scope of the present invention.

What is claimed is:

1. An injector controlling method using an opening duration comprising:

a first step of applying actuation signals to a plurality of injectors and securing a time profile of an output voltage;

a second step of evaluating the time profile to determine a closing time of the injectors;

a third step of learning an opening durations of the injectors based on the closing time;

a fourth step of selecting a standard injector out of the injectors; and a fifth step of determining second actuation signals to be inputted into the remaining injectors except the standard injector based on the learned opening duration of the standard injector.

2. The injector controlling method according to claim 1, wherein the output voltage in the first step is a self-induced voltage which is created when a current flow is interrupted after the current flow is formed on the injector by the actuation signal.

3. The injector controlling method according to claim 2, wherein the second step includes the steps of finding an inflection point from the time profile of the self-induced voltage and determining the closing time based on the inflection point.

4. The injector controlling method according to claim 3, wherein the inflection point is formed while the self-induced voltage is decayed.

5. The injector controlling method according to claim 1, wherein the second step is to find an inflection point from the time profile of the self-induced voltage by evaluating the time profile and determine the closing time based on the inflection point.

6. The injector controlling method according to claim 1, wherein the third step includes the steps of:

determining the opening time based on a current peak value of the actuation signal;

determining a time interval between the opening time and the closing time as an opening duration; and storing the determined opening duration.

7. The injector controlling method according to claim 1, wherein in the fourth step, the standard injector is selected by comparing the learned opening durations of the plural injectors.

8. The injector controlling method according to claim 1, wherein when the fuel quantity corresponding to the learned opening durations of the injectors is divided into a maximum value, an intermediate value and a minimum value, the standard injector is selected among the injectors having the intermediate value.

9. The injector controlling method according to claim 1, wherein the fifth step includes the steps of: matching the learned opening durations of the injector except the standard injector with the learned opening duration of the standard injector, comparing the actuation signal of the standard injector with the actuation signal of the remaining injectors, and determining the actuation signals of the remaining injectors corresponding with the actuation signal of the standard injector relative to the matched opening duration.

10. The injector controlling method according to claim 1, further comprising:

a sixth step of applying the actuation signal determined in the fifth step to the remaining injectors in order to control fuel quantities of the injectors.

11. The injector controlling method according to claim 10, wherein in the sixth step, the fuel quantity is determined applying the relationship between the previously mapped opening duration and the fuel quantity.

12. The injector controlling method according to claim 10, wherein in the sixth step, the fuel quantity is determined applying the relationship between the learned opening duration of the standard injector and the fuel quantity.

13. A fuel quantity controlling method of an engine in which a plurality of injectors having solenoid coils are mounted, comprising the steps of:

applying an actuation signal to the solenoid coil of each injector;

cutting a flow of current flowing through the solenoid coil when the actuation signal is applied, such that the coil is in a currentless state;

detecting a time profile of voltage induced from the coil of the currentless state;

determining a closing time of the injector based on the detected time profile;

determining an opening time of the injector based on the actuation signal, and learning relationship between an opening duration defined by the opening time and the closing time and the actuation signal; and selecting a standard injector out of the plural injectors, and deciding second actuation signals for the remaining injectors except the standard injector based on relationship between the actuation signal of the standard injector and the opening duration.

14. The fuel quantity controlling method according to claim 13, wherein the closing time in the closing time determining step is determined based on an inflection point of the time profile.

15. The fuel quantity controlling method according to claim 13, wherein the opening duration in the opening duration learning step is defined as a time zone between the opening time and the closing time.

16. A control device of an engine which has a plurality of injectors, comprising:

an actuation signal transmitting unit for transmitting actuation signals to the injectors;

an output signal receiving unit for receiving output voltage corresponding to the actuation signals from the injectors; and a control unit which secures a time profile of the output voltage and evaluates the time profile to determine a closing time of the injectors, learns relationship between an opening duration defined by an opening time and the closing time and the actuation signal, selecting a standard injector out of the plural injectors, and decides second actuation signals for the remaining injectors except the standard injector based on the opening duration of the standard injector.

* * * * *